US007217061B2

(12) United States Patent
Stratton

(10) Patent No.: US 7,217,061 B2
(45) Date of Patent: May 15, 2007

(54) BARRIER SYSTEM

(75) Inventor: Vincent E. Stratton, Marlton, NJ (US)

(73) Assignee: VES Industries, L.L.C., Marlton, NJ (US)

( * ) Notice: Subject to any disclaimer, the term of this patent is extended or adjusted under 35 U.S.C. 154(b) by 0 days.

(21) Appl. No.: 11/255,654

(22) Filed: Oct. 21, 2005

(65) Prior Publication Data

US 2007/0020044 A1 Jan. 25, 2007

Related U.S. Application Data

(60) Provisional application No. 60/595,608, filed on Jul. 19, 2005.

(51) Int. Cl.
*A47G 5/02* (2006.01)

(52) U.S. Cl. ..... 404/6; 160/250; 256/1

(58) Field of Classification Search ..... 404/6; 160/243, 250; 256/1
See application file for complete search history.

(56) References Cited

U.S. PATENT DOCUMENTS 193,573 A * 7/1877 Tripp ..... 160/25
4,070,006 A * 1/1978 Storie ..... 256/1
4,124,196 A * 11/1978 Hipskind ..... 256/1
4,993,719 A * 2/1991 Hernandez ..... 473/492
5,875,597 A * 3/1999 Gingrich et al. ..... 52/239
5,993,104 A * 11/1999 Marcotullio et al. ..... 404/6
6,142,701 A * 11/2000 Falcon ..... 404/6
6,575,435 B1 * 6/2003 Kotzen ..... 256/24
6,733,204 B1 * 5/2004 Paniccia ..... 404/6
6,807,999 B1 * 10/2004 Bowen et al. ..... 160/24
6,969,185 B1 * 11/2005 Adair ..... 362/542
7,059,980 B1 * 6/2006 Shannon, Jr. ..... 473/494

* cited by examiner

*Primary Examiner*—Gary S. Hartmann
(74) *Attorney, Agent, or Firm*—Rudoler & DeRosa LLC

(57) ABSTRACT

A barrier system comprises a first and second upright support legs and a laterally extending vision barrier. The support legs may include a pair of telescoping leg support portions. The laterally extending vision barrier comprises a vision barrier screen having slits spaced therein and has at least one fastener for facilitating attachment to one of the support legs. In one form, the first support leg may comprise an outer housing and an internal reel. The vision barrier is deployed on the reel.

8 Claims, 8 Drawing Sheets

BARRIER SYSTEM

CROSS-REFERENCE TO RELATED APPLICATION

This application is based on, and claims priority to provisional application having Ser. No. 60/595,608, having a filing date of Jul. 19, 2005, and entitled ARN Fence—Anti-Rubber Necking Fence.

FIELD OF THE INVENTION

The invention relates to barrier systems, and more particular to deployable vision barrier systems.

BACKGROUND OF THE INVENTION

There is a long standing need for the provision of a vision barrier that can separate vehicular or pedestrian traffic from an event or condition, especially a distracting event or condition, such as a vehicular accident on a highly trafficked roadway, a distressed vehicle on the roadway, or the separation of pedestrian traffic. There is a need for such a system to shield viewers on one side of the vision barrier from being distracted by the event or condition occurring on the other side such that vehicular and/or pedestrian speed is maintained and traffic jams or accidents (caused by the distraction) do not occur.

There is also a need for such a system to be readily deployable at the site and readily returnable to a storage position. There is also a need for the barrier to be easily storable in an emergency vehicle and easily deployed and returnable at the site in an expeditious manner. The barrier is intended for repeated use of a temporary or more permanent nature.

SUMMARY OF THE INVENTION

A barrier system comprises a first and second upright support legs and a laterally extending vision barrier. The support legs may include a pair of telescoping leg support portions. The laterally extending vision barrier comprises a vision barrier screen having slits spaced therein and has at least one fastener for facilitiating attachment to one of the support legs.

The vision barrier may further comprise indicia and a reflective material. And, a reflector or light may be located on a top of at least one of the support legs.

The support legs may comprise a support base for supporting the support legs in an upright position. The support base may also include at least one caster for increasing the mobility of the barrier device.

The device may also include any number of intermediate support leg for providing further support for the laterally extending vision barrier.

In another preferred embodiment, the first support leg may comprise an outer housing and an internal reel. The vision barrier is deployed on the reel. In one form of this embodiment the second support leg has a first connector the vision barrier fastener cooperates with the second support leg connector to attach the vision barrier to the second support leg. The first support leg may include a crank for rotating the reel for deploying the vision barrier. The crank can be a hand crank or motorized. In one form of this embodiment the support legs are telescoping comprising upper and lower leg portions that telescope with respect to an intermediate leg portion.

In another form of the invention, the vision barrier may comprise a first connector and the housing may comprise a second connector which cooperates with the first connector whereby the vision barrier is kept in a deployed position. The vision barrier may comprise a vision barrier screen having spaced slits located therein and a reflective material.

BRIEF DESCRIPTION OF THE DRAWINGS

For the purpose of illustrating the invention, there is shown in the drawings a form of the invention that is presently preferred; it being understood, however, that this invention is not limited to the precise arrangements and instrumentalities shown.

DETAILED DESCRIPTION OF THE PREFERRED EMBODIMENT

In FIGS. 1–9, there is shown a form of the invention that is presently preferred. In FIGS. 1–6, there is illustrated a first preferred embodiment of a barrier system 10. The barrier system 10 can be used as an accident shield a distressed vehicle shield, a pedestrian traffic shield, an egress/entrance shield, or any other type of suitable barrier system.

Figure 1:
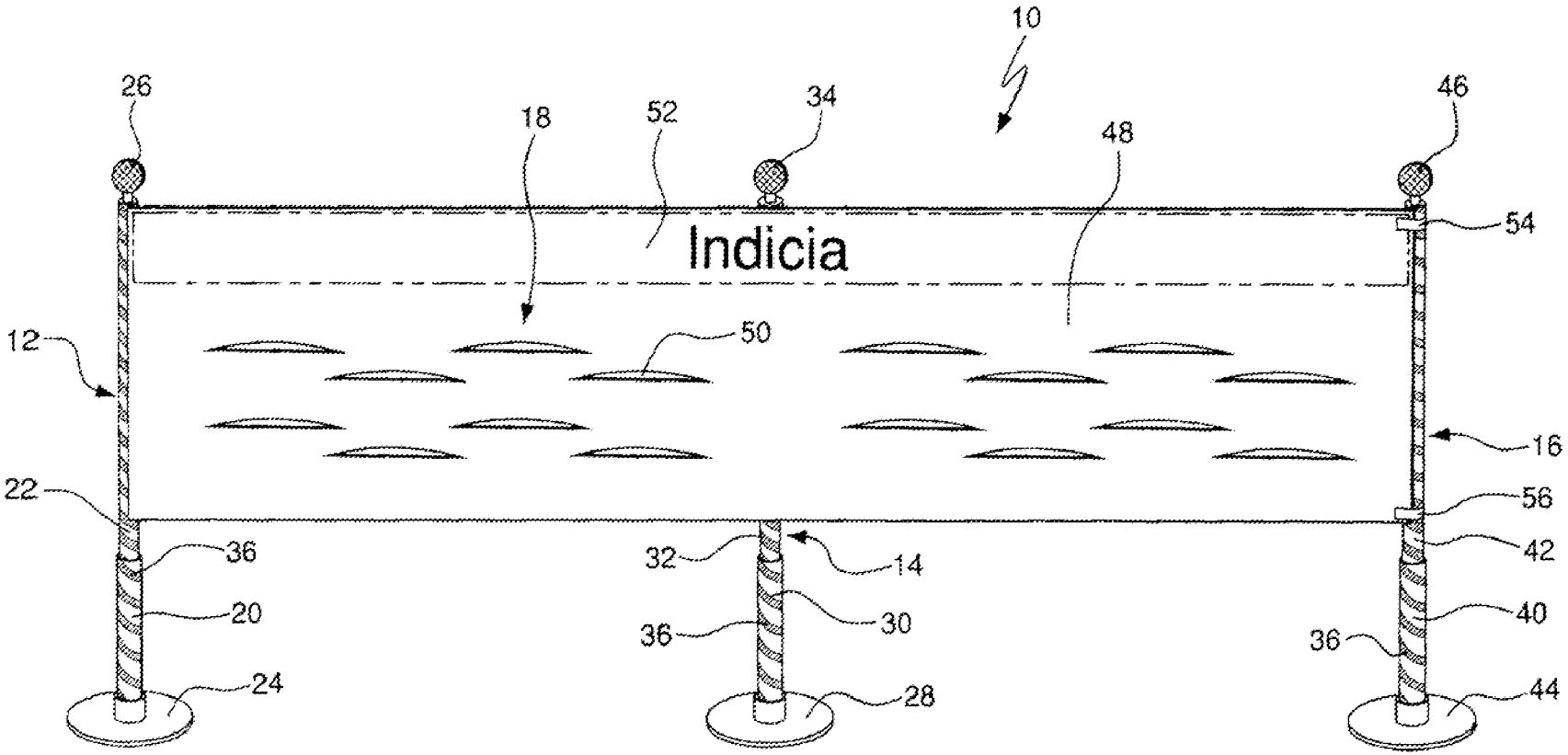
FIG. 1 is a front view of a first embodiment of a barrier system in accordance with the present invention.

Referring now to FIG. 1, the barrier system 10 includes a first upright end support leg 12, a second upright end support leg 16, and an intermediate upright support leg 14. Spanning the upright support legs 12, 14, 16 is a lateral vision barrier 18, which is attached to the support legs in either a fixed or non-fixed manner.

The first support leg 12 in the preferred embodiment takes the shape of an elongated tabular pole; however, it should be understood that many shapes and sizes of supports are suitable for supporting the lateral vision barrier 18 in a manner that serves the intended purpose of the barrier system 10. In the preferred embodiment, the upright support legs are telescoping as shown in FIG. 1. This permits each leg to be extended by some predefined distance in order to adjust the height of the vision barrier 18. In one form of the invention the support legs extend between 5 to 6 feet and the vision barrier has a height of 4 feet and a length of 20 to 40 feet.

The first end support leg 12 includes a lower leg portion 20, and an upper leg portion 22. The lower leg portion 20 fits into a suitable stand 24, which is designed to provide a suitable ballast for the leg and is adaptable to a wide range of surfaces that the barrier system is intended to be used on. In FIG. 1, the telescoping support legs are shown with the upper leg 22 telescoping inside the lower support leg 20; however, it should be understood that these parts may be reversed depending on the application such that the upper leg 22 is the outer tube portion and the lower section 20 is the inner tube portion. A reflector or other warning light 26 may be provided on the top of the support leg to aid in the visual noticeability of the device. Similarly, support leg can be wrapped in a reflective tape 36 or other suitable visual warning device to also aid in the attractiveness of the device. Other types of warning devices, such as available and tactile devices, are also contemplated.

Similar to support leg 12 are support legs 14 and 16. Support leg 14 has a lower support 30 and an upper support 32, while support leg 16 has a lower support 40 and an upper support 42. In addition, the support leg 16 includes a base 28 while the support leg 16 includes a base 44. It should be understood that base 24, base 28, and base 44 are also functionally similar. As indicated above, the weight of the support legs are determined such that they can maintain the barrier system in an upright condition when deployed in the field, such as a highway.

The lateral vision barrier 18 is constructed from a plastic or fabric material 48. The preferred material for the vision barrier screen 48 is nylon. However, it should be understood that many strong, weather resistant material are suitable for use. A series of slits or openings 50 may be provided in a repeated pattern in the vision barrier screen 48 to defuse the air pressure acting on the screen due to the forces of wind and traffic. In addition, suitable indicia or reflective material 52 may be provided on the vision barrier screen 48 to serve as a warning indicator. The indicia can be a warning or message sign or some other type of logo or trademark used in connection with the barrier system. Similarly, the reflective material can also aid in the visual characteristics of the device. The primary purpose of the lateral vision barrier 18 is to prevent people from seeing on the other side of the barrier screen. So, any material that can perform this function would be suitable for use in this device. In one form, the vision barrier 18 when deployed should serve as a vision barrier to a vehicular roadway problem from passing vehicular traffic.

The support legs 12, 14, 16 can be manufactured out of any suitably strong yet light weight yet durable material such as PVC or the like. Other suitable materials may include polyethylene, aluminum, carbon fiber or the like. As indicated above in this specification, the support stands 24, 28, 44 are preferably constructed from a material that is sufficiently heavy to support the support legs in an upright position while holding the lateral vision barrier 18 in use in a field condition while still maintaining an upright position when exposed to environmental conditions such as wind, rain, snow, or heavy vehicular traffic. In one form of the invention the support legs may have a ballast added, such as in the base.

The vision barrier screen 48 is attached to the upright support legs 12, 14, 16 by any suitable fastening device. In the preferred embodiment, the vision barrier screen 48 is attached to the support legs by use of hook and loop fastener straps 54 and 56.

Figure 2:
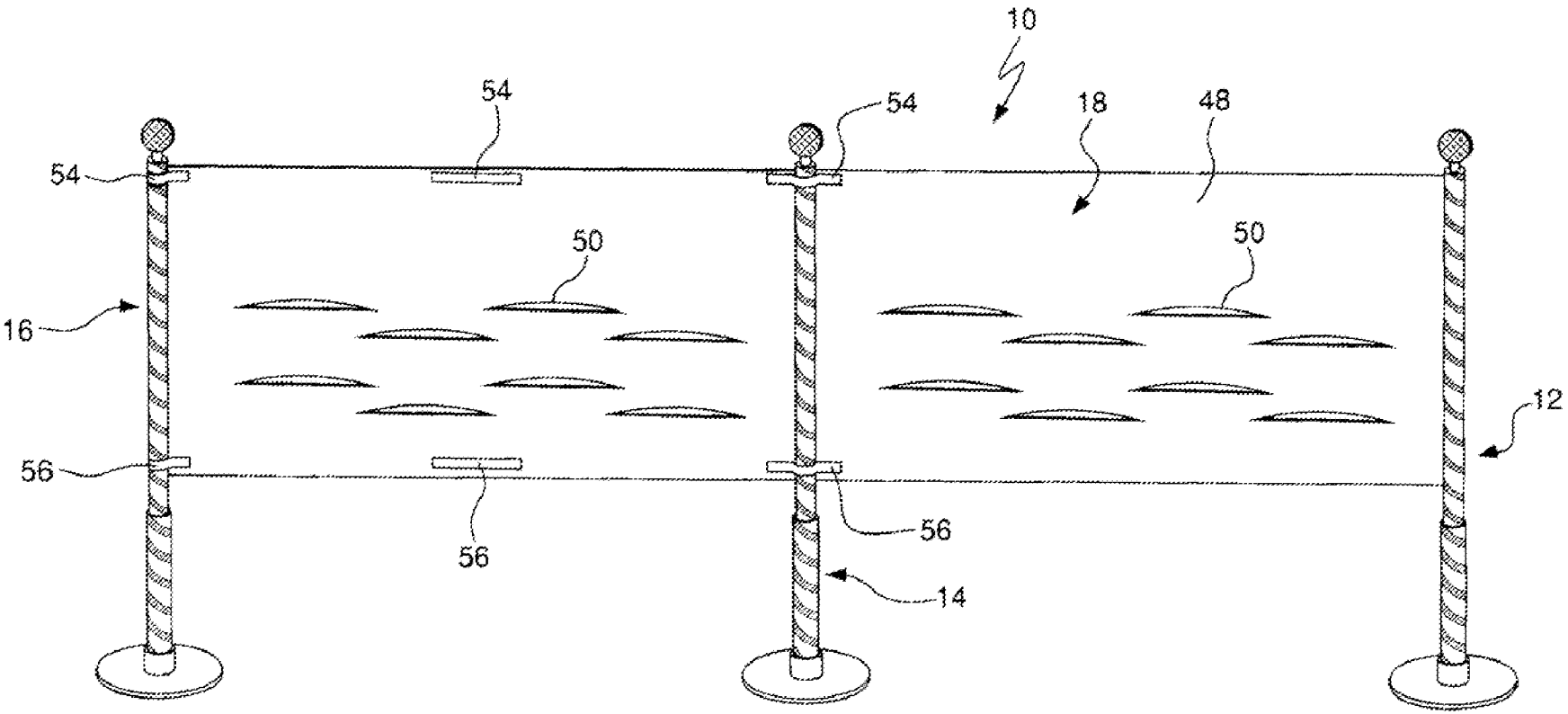
FIG. 2 is a rear view of the barrier system of FIG. 1.

Turning now to FIG. 2, the rear view of the barrier system 10, the attachment of the lateral vision barrier 18 to the support legs is more clearly shown. In the embodiment shown, the lateral vision barrier 18 is fixedly attached to the first support leg 12. However, non-fixed means of attachment are also within the scope of the invention. An upper hook and loop fastener 54 and a lower hook and loop fastener 56 are provided on the opposite end of the vision barrier 18 for connecting to the second support leg 16. Intermediate support leg 14 can be attached to one of the intermediate hook and loop fasteners 54/56 spaced along the vision barrier 18. Cooperating hook and loop fasterners are also provided on the support poles to interact with fasteners 54, 56. Depending upon the length and material of the vision barrier 18, any number of intermediate support leg 14 can be provided to provide suitable support to the lateral vision barrier 18 in use in the field. The number of intermediate support legs required depends on many variable such as length of the visions, weather conditions, field conditions, and the like.

In the embodiment shown in FIG. 2, a single intermediate support leg 14 is depicted, however, any number of intermediate supports could be used. An additional hook and loop fastener 54 and 56 may be provided along the length of the vision barrier 18. For example, a pair of hook and loop fasteners 54, 56 are provided in between the support leg 14 and the support leg 16 on the vision barrier to accommodate an additional support leg. It is contemplated that any number of these intermediate hook and loop fasteners can be provided along the length of the vision barrier depending on the various needs of the device. Although the preferred form of the fastener is a hook and loop fastener, any suitable fastener may be used with the device such as, tie wraps, releasable adhesive connections, and the like.

Figure 4:
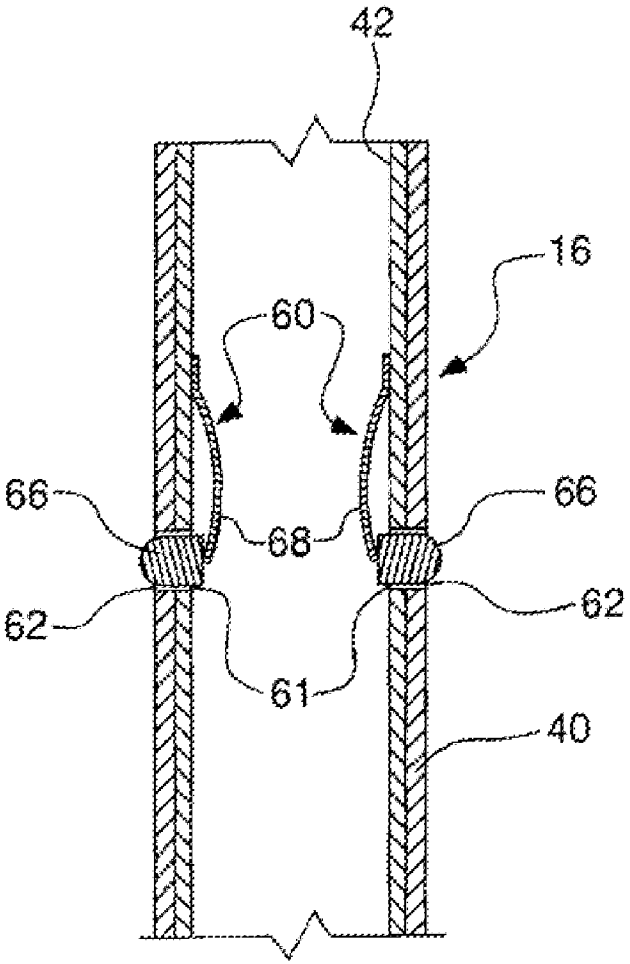
FIG. 4 is a cross-sectional view of the barrier system taken along lines 4—4 of FIG. 3.
Figure 3:
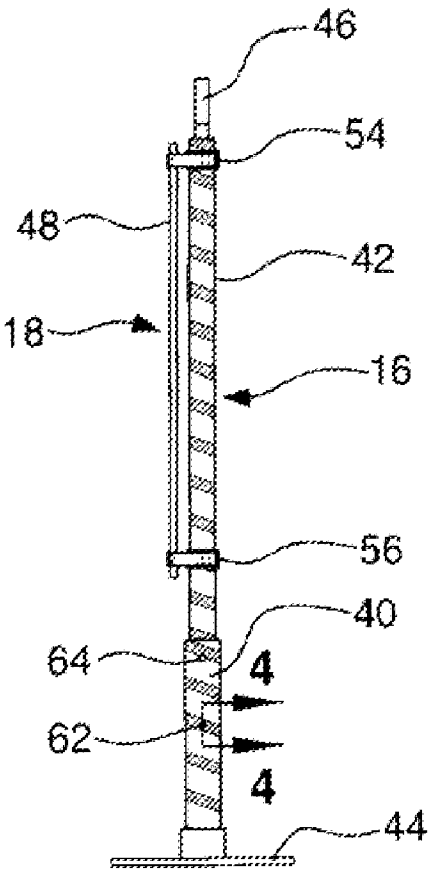
FIG. 3 is a side view of the barrier system of FIG. 1.

Turning now to FIGS. 3 and 4, the telescoping mechanism of the current invention is depicted. As best seen in FIG. 4, the barrier system 10 includes a detent stop mechanism 60 attached to one of the tubular supports of the support legs. In the embodiment shown, the detent 60 includes a pair of springs or biasing means, such as the leaf springs shown, 68 with one end of the leaf spring attached to the inner wall of the tubular support and the other end of the leaf spring attached to a rounded protrusion 66. The round protrusion 66 is sized and shaped such that it can extend through a pair of holes, 61 and 62 formed in the lower and upper tubular supports 40, 42 respectively. The leaf springs 68 bias the rounded protrusions 66 outwardly through the opening 61, 62 such that the telescoping tubular supports 40, 42 are locked into position. In use, a user presses inwardly upon the rounded protrusion 66 against the force of the biasing spring 68. When the protrusions are pressed inwardly such that its outer most end of the protrusion is within the inner wall of the outer support leg 40, the support legs 40 and 42 can be moved relative to each other until the additional hole 64 formed in the outer support leg 40 is aligned with the hole 61 in the support leg 42. At this point, the rounded protrusions are forced outwardly by the force of the biasing spring 68 thereby locking the telescoping support legs into a second extended position. Of course, any suitable stop mechanism can be used to lock the support legs into various extended positions as it well known to those skilled in the art. The spacing of the holes 61 and 61 correspond to a compact storage portion and an extended use position of the support leg. It should also be understood that the support leg can be used in the field in the compact position depending upon filed conditions and user needs. The invention also contemplates the inclusion of additional position openings or less position openings if desired.

Figure 6:
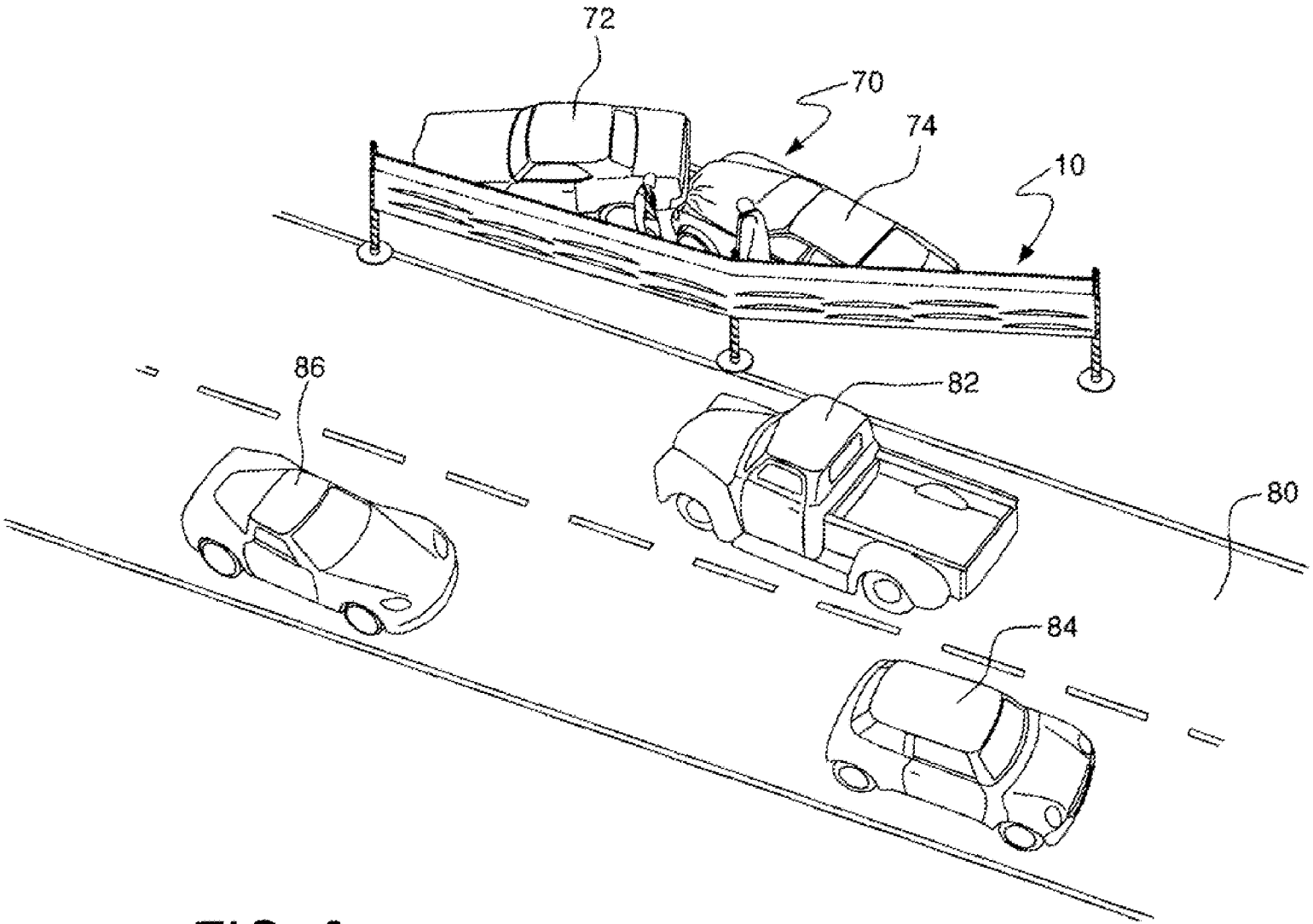
FIG. 6 is a diagramatic view of the barrier system of the present invention deployed in a use as a traffic screen.

Turning now to FIG. 6, the barrier system 10 of the present invention is shown in use in a highway road condition. FIG. 6 depicts an accident 70 having occurred on the side of the road between a car 72 and a second car 74. The support barrier system 10 can be extended so as to cover the entire portion of the accident 70 such as shown in FIG. 6. This would visually block the accident from vehicles 82, 84, and 86 traveling along the roadway 80 and would serve to prevent unnecessary delays and traffic jams caused by the traffic accident 70. In use, the support legs could be stored in the trunk of an emergency vehicle such as a police vehicle, fire truck, or other emergency vehicle. The vision barrier 18 can then be wound around one of the supports or otherwise placed inside the trunk of the vehicle. When it is time to use the barrier system 10, the support legs are spaced along the ground in such a manner to adequately support the lateral vision barrier 18, depending upon field conditions, when the barrier is unfurled or deployed along the side of the road to visually block whatever needs to be blocked. Once the support legs are placed in approximately their desired position, the lateral vision barrier 18 can then be attached to each of the support legs in turn to form the assembled barrier system 10. Optionally, the telescoping support legs can be extended to increase the height of the barrier system in its operative condition to adjust the visual screen function as needed.

Figure 5:
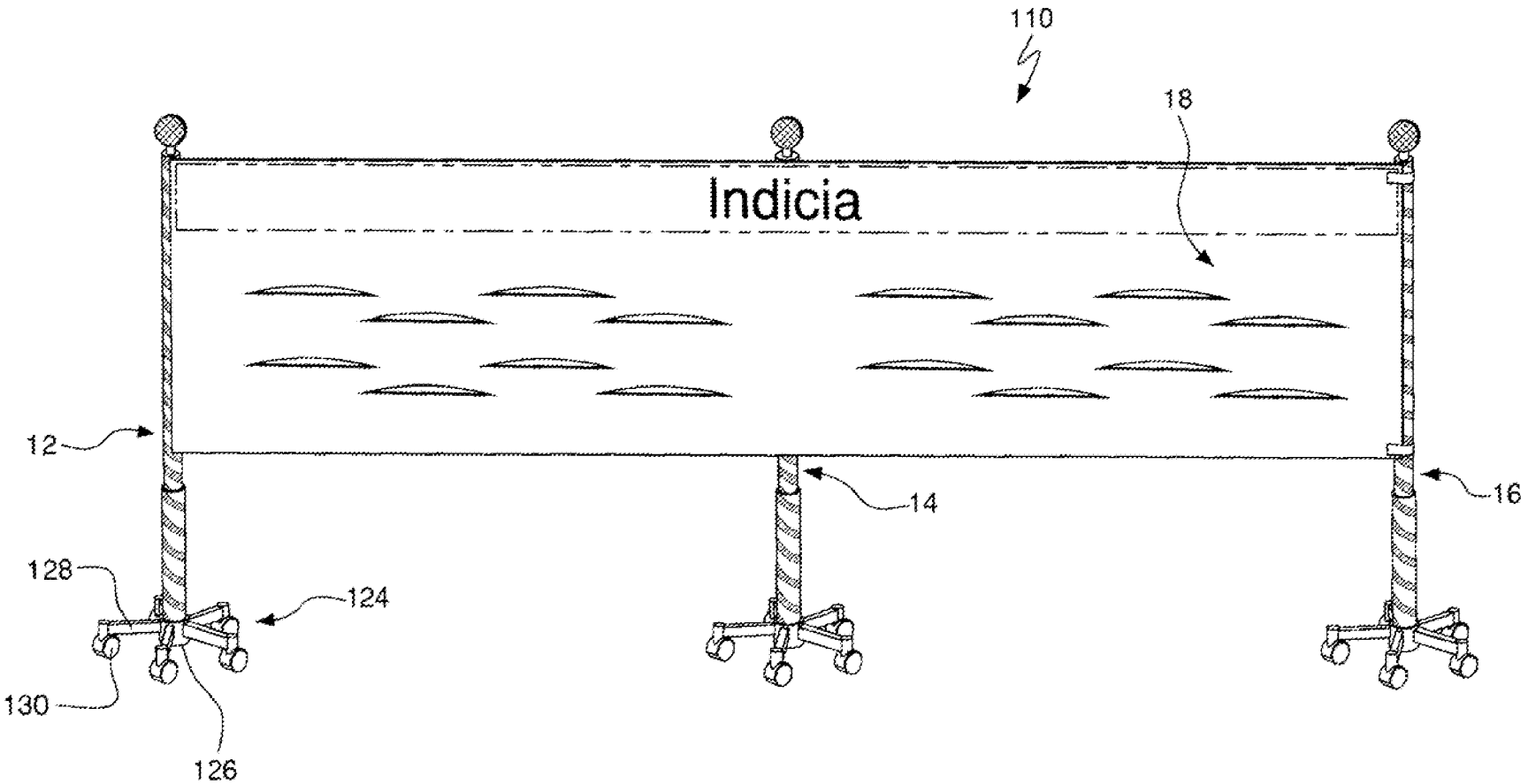
FIG. 5 is a front view of second preferred embodiment of the barrier system in accordance with the present invention.

In FIG. 5 there is depicted a second preferred embodiment of the present invention wherein like reference numerical indicate like elements. The barrier system 110 is similar to the barrier system 10 depicted in FIGS. 1–4 with the exception that the barrier system 110 includes a mobile base 124 that facilitates positioning of the support legs 12, 14, 16. The mobile base 124 includes a collar 126 for connecting to the lower portion of the support leg. A plurality of extension arms 128 extend in a spaced condition from the collar connection 126. Attached to the end of each extension arm 128 are lockable casters or wheels 130 to facilitate movement of the support leg. It should be understood that many variations of the mobile base are contemplated and fall within the scope of the invention.

Figure 7:
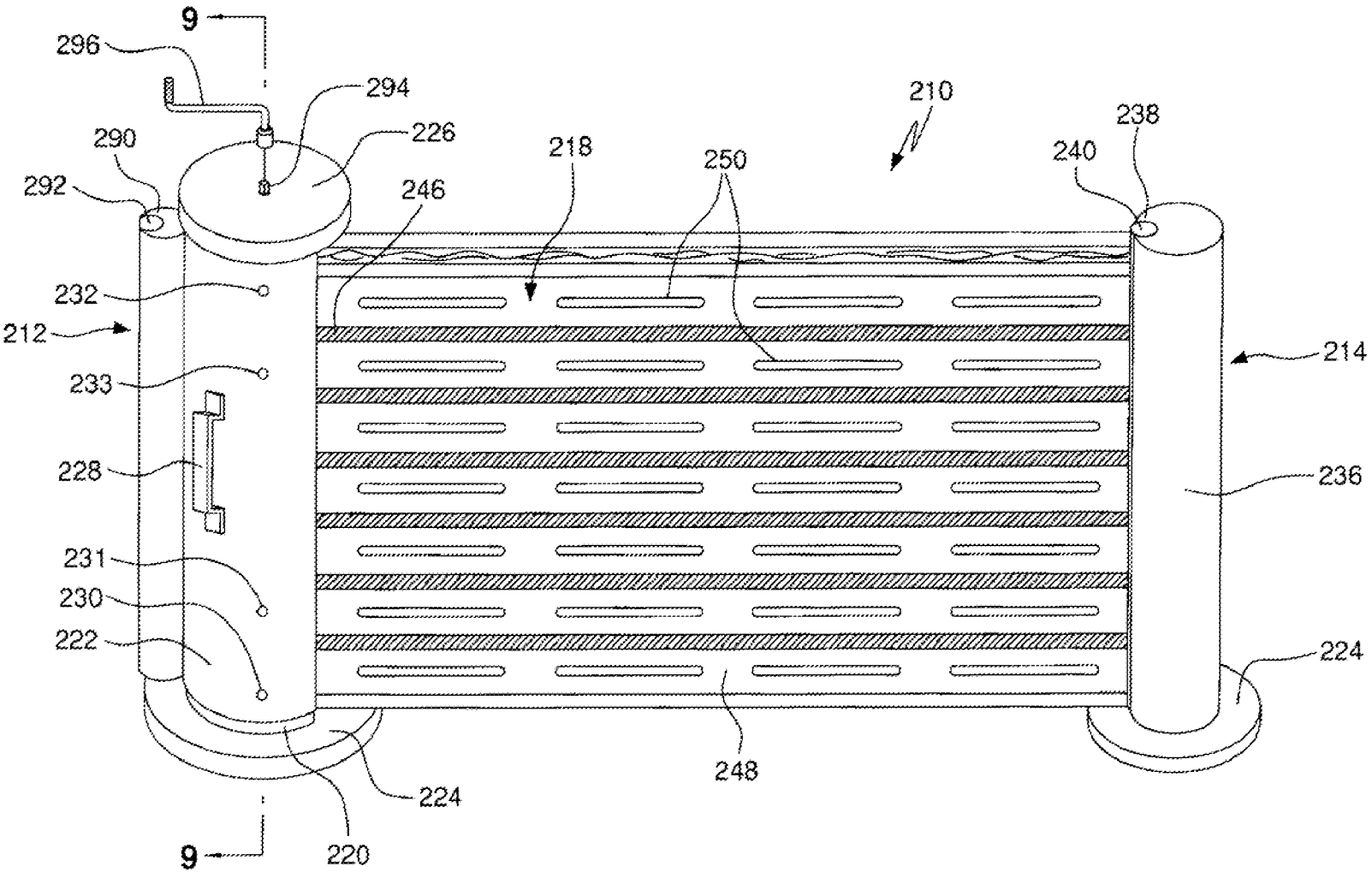
FIG. 7 is front view of a third preferred embodiment of a barrier system in accordance with the present invention.
Figure 8:
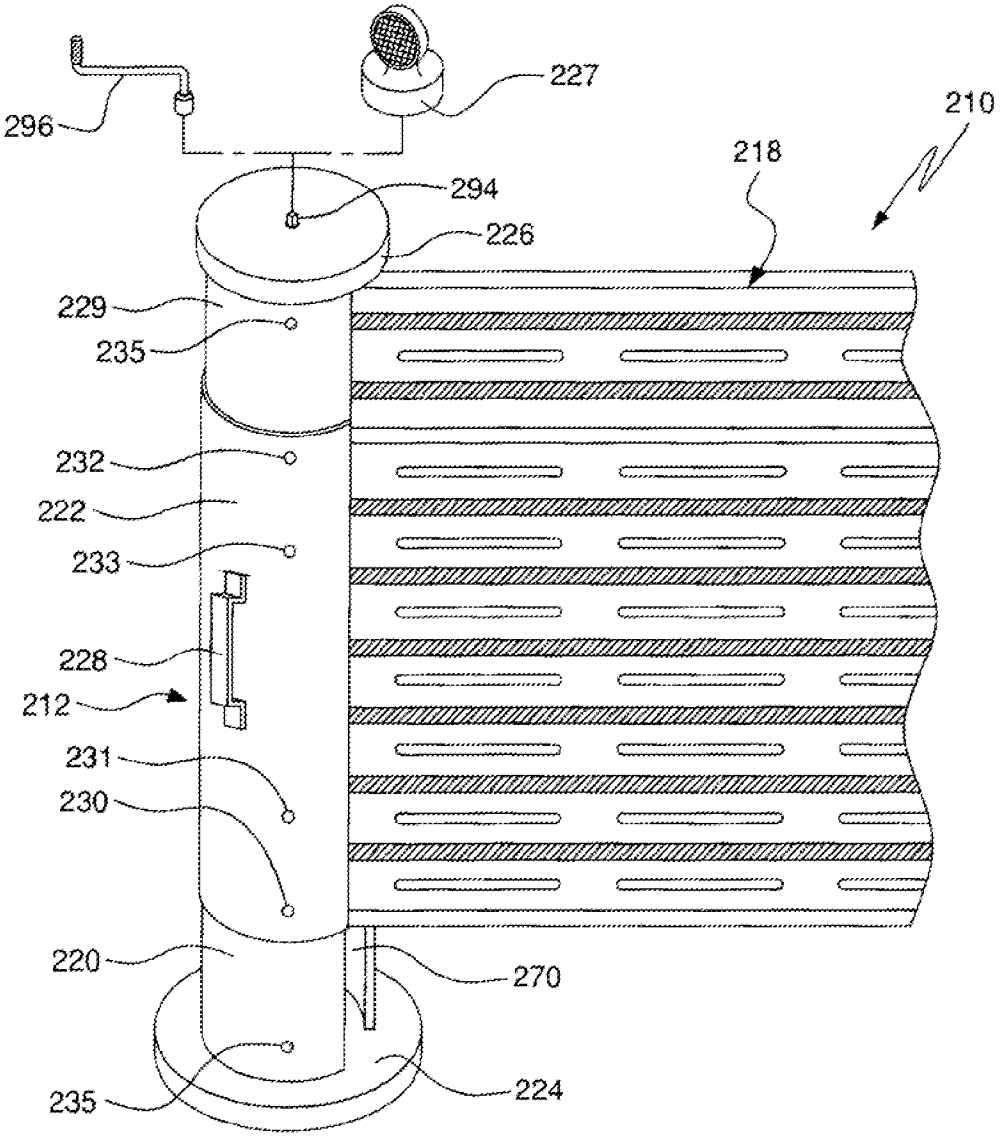
FIG. 8 is a partial front view of the barrier system of FIG. 7 in a deployed position.
Figure 9:
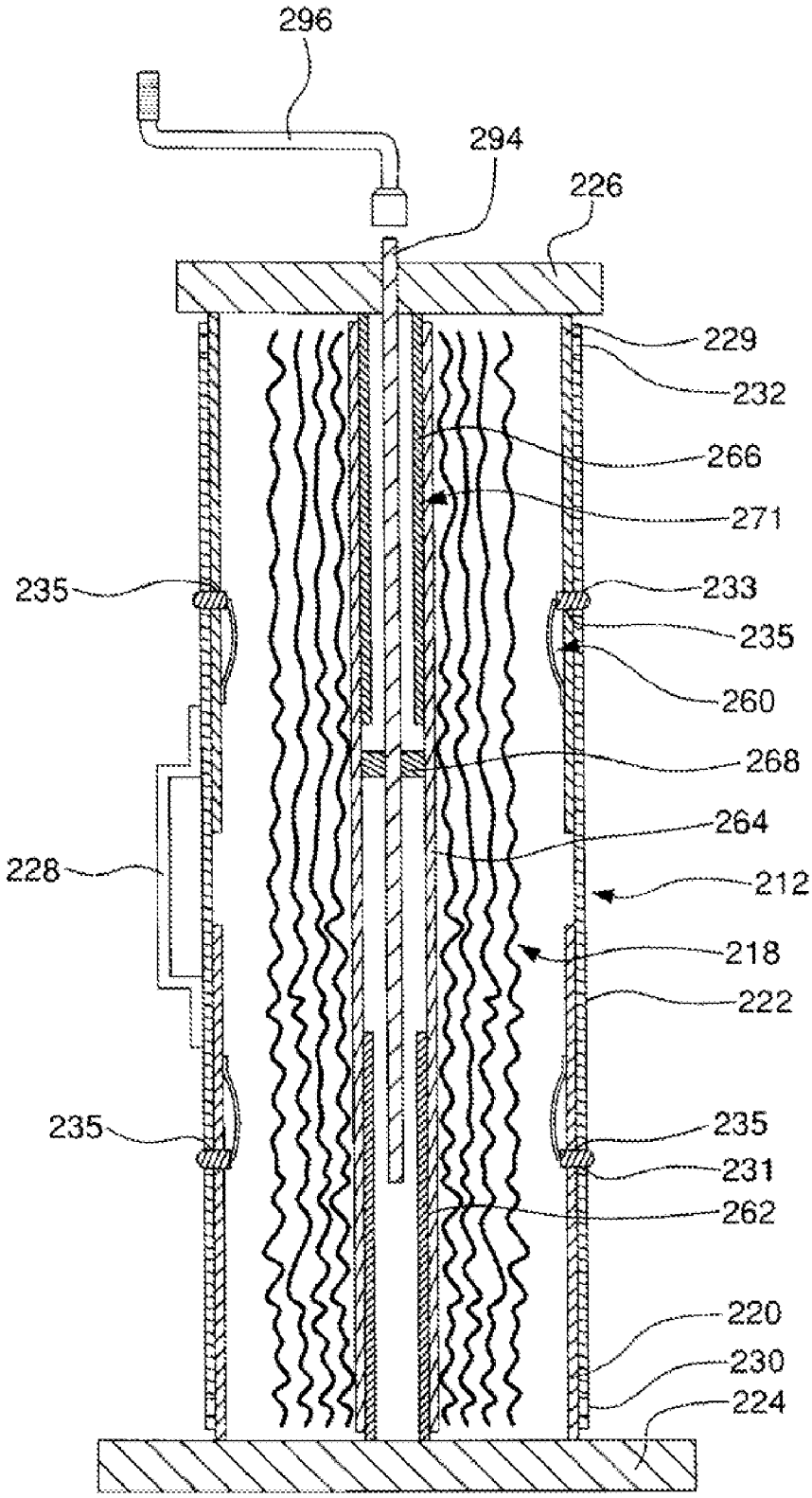
FIG. 9 is a cross-sectional view of the barrier system taken along lines 9—9 of FIG. 7.

Turning now to FIGS. 7–9, there is shown a third preferred embodiment of the barrier system 210 in which like reference numerals indicate like structural components. The barrier system 210 is similar to barrier systems 10 and 110 with the exceptions noted below. As best seen in FIG. 7, the barrier system 210 includes a first end support leg 212 and a second end support leg 214. The first end support leg 212 houses a lateral vision barrier 218 which can be retracted from the support leg 212 through an opening 270 and connected to the second end support leg 214 as will be described in greater detail below.

The first end support leg 212 includes a base 224 which can be either stationary or mobile as depicted in the previous two embodiments. The base 224 is attached to a lower support leg portion 220 which is telescopingly attached to an intermediate support leg portion 222 which is telescopingly attached to an upper support leg portion 229 (shown in FIG. 8). An upper end plate 226 is attached to the upper support leg portion 229. A handle of 228 may be provided on the barrier system to facilitate carrying of the support leg by a user. A crank handle 296 may also be provided in connection with a hub rod 294 for retracting and deploying the lateral vision barrier to 218 as will be described in detail below. It should be understood that the support leg and have more or less telescoping portion depending upon the user's needs. In addition the invention also contemplates a support leg that is not telescoping and having no telescoping sections for simplified deployment.

The second end support leg 214 includes a base 224 connected to an upright support leg 236. The second support leg 214 can be telescoping like the first support leg 212. A channel 238 is provided to the length of the support leg 236 for attachment to a cooperating connection 240 at the end of the lateral vision barrier of 218. It should be understood, the support base may be stationary or mobile as described previously and it is contemplated that the support leg 214 can have a suitable weight and dimension to maintain itself in an upright position when in use in the field. The invention also contemplates that the support legs 212 and 214 can have any suitable shape, not just cylindrical.

The lateral vision barrier 218 is construction from a barrier screen 248 is similar to the vision barriers 48 described in connection with the first embodiment. Openings or slits 250 may be provided along the barrier screen 248 to diffuse wind and the light as described in connection with the first embodiment. Also various reflective material 236 may also be provided along the barrier screen 248 to facilitate the visual attractiveness of the device. Indicia may also be provided on the screen 248 as described in the first embodiment.

The first support leg 212 can be provided with a elongated connection 290 having a connection channel 292 similar to that provided in the second support leg 214. This optional channel 290 allows multiple support legs 212 to be used together to create a barrier system of whatever thickness, whatever length is desired. For example these legs 212 can be connected together using the connection 290 and one leg 214 at the end of the run.

Turning now to FIG. 8, the barrier system 210 is shown with the first end support leg in an extended position. In FIG. 7, the first end support leg 212 is shown in the more compact or storage position. The extension mechanism for extending the support leg 212 is similar to the extension mechanism described in connection with the first embodiment. The lower support leg portion 220 and the upper support leg portion 229 telescope within the outer intermediate support leg portion 222. It should be understood that the support leg 212 can be formed such that the intermediate support leg portion 222 telescopes within the upper and lower support leg portions 220, 229. Naturally, in such a configuration the diameters of the upper and lower support leg portions would have to be larger than the intermediate support leg portion.

The intermediate support leg portion 222 is provided with a pair of lower openings 230 and 231 and a pair of upper openings 233 and 232. The location of these openings represent an extended and a compact position respectively for the upper and lower support leg portions.

It should be understood that the upper and lower leg portions can be extended independently depending upon the user's needs. As described in greater detail below, extending the upper leg portion increases the height of the screen, while extending the lower leg portion extends the screen off the ground thereby raising the screen. As best seen in FIG. 9, a bias detent mechanism 260 is provided similar to that described in connection with the first embodiment. Since there are two telescoping leg portions, a pair of these biased detent mechanisms are provided for each leg portion. Cooperating openings 235 are provided in the upper 229 and lower 220 support leg portions for the detent to pass through.

When the barrier system 210 is deployed in the field, the crank handle 296 may be replaced with a reflector or light 227 to provide a more noticeable appearance for the farrier system 10. An opening 270 is provided along the length of the first end support leg 212 and is formed in the upper, lower and intermediate support legs. This channel opening 270 permits the lateral vision barrier 218 to be dispensed from the housing form by the first support leg 212 for deployment or retracting.

A reel 271 is provided inside the first end support leg housing 212. The reel 270 comprises an elongated rod 294 that extends through the top of the end cap 226 and provides an attachment means for cooperating with the crank handle 296 and also a means for attaching the reflector 226. A collar 268 is formed around the central portion of the rod 294. The collar 268 attaches the rod 294 to a tubular reel support 264 that extends the length of the first end support leg 212. An annular bearing 266 extends from the end cap 226 and another annular bearing 262 extends from the bottom end cap 224. The bearings 262 and 266 permit the support reel 264 to rotate on the bearings to form the reel mechanism. The lateral vision barrier 218 is wrapped around the support reel 264 such that when the reel 271 is rotated by means of the crank handle 296 through the rod 294, the vision barrier screen can be retracted and deployed through the opening 270.

In FIG. 9, the vision barrier screen 248 is shown in a compressed condition since the first end support leg 212 is shown in the compacted or storage position. However, it should be understood that when the support leg is extended, the vision barrier screen material 248 will also be extended to a more taut condition and increasing the height of the screen 248. It should also be understood that either of the telescoping extension support legs 229 and 220 can be extended and retracted independently, depending upon the field use conditions of the vision barrier system 210.

The present invention may be embodied in other specific forms without departing from the spirit or essential attributes thereof and, accordingly, reference should be made to the appended claims, rather than to the foregoing specification, as indicating the scope of the invention.

What is claimed:

1. A barrier system comprising:

an upright telescoping support leg, the support leg comprising a support base, an outer housing extending from the support base, the outer housing comprising a lower leg portion extending from the support base, an intermediate leg portion telescopingly extending from the lower leg portion, and an upper leg portion in telescoping extending from the intermediate leg portion, whereby the support leg is extendible between a first compact position and a second extended position;

an internal telescoping reel located inside the housing and extending upwardly from and rotatably mounted to the support base;

an opening located in a wall of the housing formed by the lower, intermediate, and upper leg portions, the reel being extendible between a first compact position and a second extended position; and a laterally extending vision barrier disposed on the reel such that when the reel is rotated the barrier is deployed through the opening.

2. The barrier system of claim 1, further comprising a lock for locking the support leg into the first and second positions.

3. The barrier system of claim 1, wherein the vision barrier comprises a first connector and the housing comprises a second connector which cooperates with the first connector whereby the vision barrier is kept in a deployed position.

4. The barrier system of claim 1, wherein the vision barrier comprises a vision barrier screen having spaced slits located therein.

5. The barrier system of claim 4, wherein the vision barriers comprises a reflective material.

6. The barrier system of claim 1, wherein the outer housing further comprises a handle for facilitating movement of the barrier system.

7. The barrier system of claim 1, wherein the reel further comprises a crank connected to an end of the reel.

8. The barrier system of claim 1, wherein the reel further comprises a lower reel portion extending from the support base, an intermediate portion telescopingly extending from the lower reel portion, and an upper reel portion telescopingly extending from the intermediate reel portion, whereby the reel is extendible between a first compact position and a second extended position.

* * * * *